US008941694B2

(12) United States Patent
Smith et al.

(10) Patent No.: US 8,941,694 B2
(45) Date of Patent: Jan. 27, 2015

(54) METHOD OF DRIVING AN ELECTRO-OPTIC DISPLAY UTILIZING INTERNAL CAPACITANCE TO SMOOTH A DIGITALLY MODULATED SIGNAL

(75) Inventors: Euan C. Smith, Cambridge (GB); David S. Warren, Campbell, CA (US); Richard Alan Page, Mountain View, CA (US); Stefan Wurster, Livermore, CA (US); Barry Thompson, Menlo Park, CA (US)

(73) Assignee: Cambridge Display Technology Limited, Cambridgeshire (GB)

( * ) Notice: Subject to any disclaimer, the term of this patent is extended or adjusted under 35 U.S.C. 154(b) by 533 days.

(21) Appl. No.: 12/680,444

(22) PCT Filed: Sep. 26, 2008

(86) PCT No.: PCT/GB2008/003303

§ 371 (c)(1),
(2), (4) Date: Jun. 9, 2010

(87) PCT Pub. No.: WO2009/044122

PCT Pub. Date: Apr. 9, 2009

(65) Prior Publication Data

US 2010/0245401 A1 Sep. 30, 2010

(30) Foreign Application Priority Data

Oct. 5, 2007 (GB) ..... 0719516.7

(51) Int. Cl.
*G09G 5/10* (2006.01)
*G09G 3/30* (2006.01)
(Continued)

(52) U.S. Cl.
CPC ..... *G09G 3/3216* (2013.01); *G09G 3/2014* (2013.01); *G09G 2310/0208* (2013.01); *G09G 2320/043* (2013.01); *G09G 2330/025* (2013.01)
USPC ..... 345/690; 345/77

(58) Field of Classification Search
CPC ..... G09G 3/30; G09G 3/32; G09G 3/3208; G09G 3/3216; G09G 3/3233; G09G 3/3283; G09G 2300/06; G09G 2300/0828; G09G 2310/021; G09G 2310/0218; G09G 2320/0247; G09G 2320/043; G09G 2330/025; H03M 3/00; H03M 3/30; H03M 5/02; H03M 5/08
USPC ..... 345/76–80, 82, 204, 211–214, 345/690–691; 315/169.3
See application file for complete search history.

(56) References Cited

U.S. PATENT DOCUMENTS 4,190,836 A * 2/1980 Kimura et al. ..... 345/46
4,539,507 A 9/1985 VanSlyke et al.
(Continued)

FOREIGN PATENT DOCUMENTS

DE 103 57 776 B4 12/2005
EP 1 528 841 A3 7/2005
(Continued)

OTHER PUBLICATIONS

"Organic light emitting devices (OLEDs) and Structurally integrated photoluminescence based chemical and biological sensors excited by OLEDs", Bhaskar Choudhury, published 2006, pp. 1-132 [online], retrieved from the internet, see URL below: <URL: http://archives.ece.iastate.edu/archive/00000204/01/Organic_light_emitting_devices_(OLEDs)_and_structurally_integrated_photoluminescence_based_chemicaland_biological_sensors_excited_by_OLEDs.pdf>.*
(Continued)

*Primary Examiner* — Temesgh Ghebretinsae
*Assistant Examiner* — Keith Crawley
(74) *Attorney, Agent, or Firm* — Marshall, Gerstein & Borun LLP

(57) ABSTRACT

A method of driving an electro-optic display comprising providing a current source, digitally modulating the current source and generating a modulated digital signal, and converting the modulated digital signal into an effective analog drive signal so that the display pixels receive an effective analog drive current, wherein the internal capacitance of the electro-optic display smooths the digitally modulated signal and generates the effective analog drive signal.

8 Claims, 5 Drawing Sheets

(51) Int. Cl.
*G09G 3/32* (2006.01)
*G09G 3/20* (2006.01)

(56) References Cited

U.S. PATENT DOCUMENTS

| | | | | |
|---|---|---|---|---|
| 4,845,489 | A * | 7/1989 | Hormel | 345/211 |
| 5,594,463 | A | 1/1997 | Sakamoto | |
| 6,429,600 | B1 * | 8/2002 | Fujita et al. | 315/169.3 |
| 7,471,050 | B2 * | 12/2008 | Shimada et al. | 315/291 |
| 7,656,366 | B2 * | 2/2010 | Ashdown | 345/46 |
| 2002/0167474 | A1 * | 11/2002 | Everitt | 345/82 |
| 2004/0008326 | A1 * | 1/2004 | Koide | 353/99 |
| 2004/0189558 | A1 * | 9/2004 | Yoshida et al. | 345/82 |
| 2004/0196275 | A1 * | 10/2004 | Hattori | 345/204 |
| 2005/0078051 | A1 * | 4/2005 | Abe et al. | 345/1.1 |
| 2007/0085779 | A1 * | 4/2007 | Smith et al. | 345/76 |

FOREIGN PATENT DOCUMENTS

| | | | |
|---|---|---|---|
| WO | WO-90/13148 | A1 | 11/1990 |
| WO | WO-95/06400 | A1 | 3/1995 |
| WO | WO-99/21935 | A1 | 5/1999 |
| WO | WO 99/48160 | A1 | 9/1999 |
| WO | WO-02/067343 | A1 | 8/2002 |
| WO | WO-2006/035246 | A1 | 4/2006 |
| WO | WO-2006/035247 | A1 | 4/2006 |
| WO | WO-2006/035248 | A1 | 4/2006 |
| WO | WO-2006/067520 | A3 | 4/2008 |

OTHER PUBLICATIONS

European Examination Report for Application No. 08806453.0, dated Mar. 19, 2012.

Great Britain Search Report for Application No. 0719516.7, dated Feb. 6, 2008.

International Preliminary Report on Patentability for Application No. PCT/GB2008/003303, dated Apr. 7, 2010.

International Search Report and Written Opinion for Application No. PCT/GB2008/003303, dated Jan. 20, 2009.

* cited by examiner

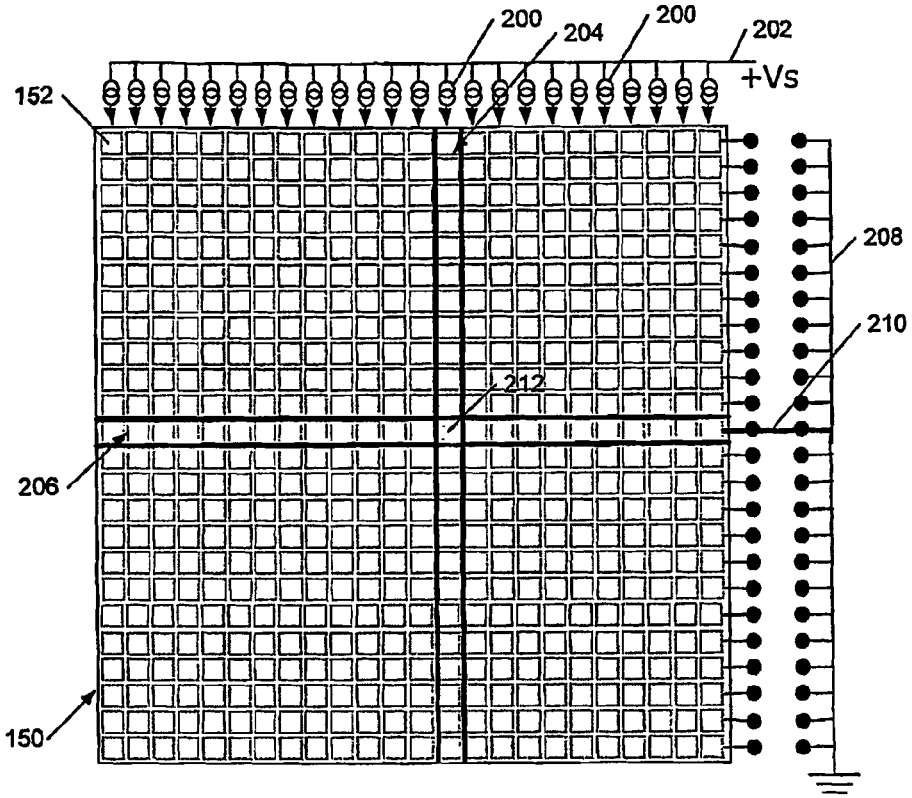
Figure 2a
Figure 2b
Figure 2c
Figure 2d
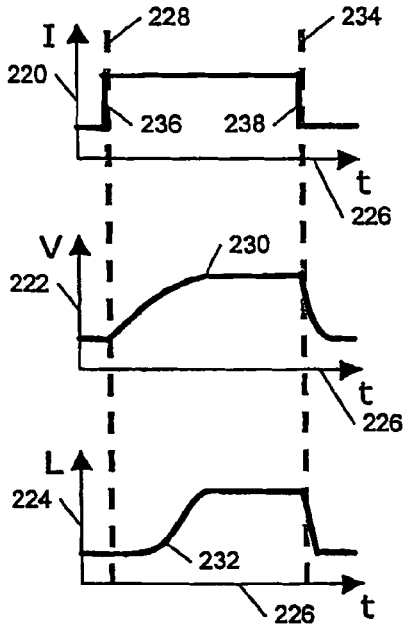

300

METHOD OF DRIVING AN ELECTRO-OPTIC DISPLAY UTILIZING INTERNAL CAPACITANCE TO SMOOTH A DIGITALLY MODULATED SIGNAL

BACKGROUND OF THE INVENTION

1. Field of the Invention

Organic light emitting diodes (OLEDs) comprise a particularly advantageous form of electro-optic display. They are bright, colorful, fast switching, provide a wide viewing angle and are easy and cheap to fabricate on a variety of substrates.

2. Related Technology

Organic (which here includes organometallic) LEDs may be fabricated using either polymers or small molecules in a range of colors, depending upon the materials used. Examples of polymer-based organic LEDs are described in WO 90/13148, WO 95/06400 and WO 99/48160; examples of small molecule based devices are described in U.S. Pat. No. 4,539,507 and examples of dendrimer-based materials are described in WO 99/21935 and WO 02/067343.

A basic structure 100 of a typical organic LED is shown in FIG. 1*a*. A glass or plastic substrate 102 supports a transparent anode layer 104 comprising, for example, indium tin oxide (ITO) on which is deposited a hole transport layer 106, an electroluminescent layer 108 and a cathode 110. The electroluminescent layer 108 may comprise, for example, PEDOT: PSS (polystyrene-sulphorate-doped polyethylene-dioxythiophene). Cathode layer 110 typically comprises a low work function metal such as calcium and may include an additional layer immediately adjacent electroluminescent layer 108, such as a layer of aluminum, for improved electron energy level matching. Contact wires 114 and 116 to the anode and the cathode respectively provide a connection to a power source 118. The same basic structure may also be employed for small molecule devices.

In the example shown in FIG. 1*a* light 120 is emitted through transparent anode 104 and substrate 102 and such devices are referred to as "bottom emitters". Devices which emit through the cathode may also be constructed, for example, by keeping the thickness of cathode layer 110 less than around 50-100 mm so that the cathode is substantially transparent.

Organic LEDs may be deposited on a substrate in a matrix of pixels to form a single or multi-color pixilated display. A multi-colored display may be constructed using groups of red, green and blue emitting pixels. In such displays the individual elements are generally addressed by activating row (or column) lines to select the pixels, and rows (or columns) of pixels are written to, to create a display. So-called active matrix displays have a memory element, typically a storage capacitor and a transistor, associated with each pixel while passive matrix displays have no such memory element and instead are repetitively scanned, somewhat similarly to a TV picture, to give the impression of a steady image.

FIG. 1*b* shows a cross-section through a passive matrix OLED display 150 in which like elements to those of FIG. 1*a* are indicated by like reference numerals. In the passive matrix display 150 the electroluminescent layer 108 comprises a plurality of pixels 152 and the cathode layer 110 comprises a plurality of mutually electrically insulated conductive lines 154, running into the page in FIG. 1*b*, each with an associated contact 156. Likewise the ITO anode layer 104 also comprises a plurality of anode lines 158, of which only one is shown in FIG. 1*b*, running at right angles to the cathode lines. Contacts (not shown in FIG. 1*b*) are also provided for each anode line. An electroluminescent pixel 152 at the intersection of a cathode line and anode line may be addressed by applying a voltage between the relevant anode and cathode lines.

Referring now to FIG. 2*a*, this shows, conceptually, a driving arrangement for a passive matrix OLED display 150 of the type shown in FIG. 1*b*. A plurality of constant current generators 200 are provided, each connected to a supply line 202 and to one of a plurality of column lines 204, of which for clarity only one is shown. A plurality of row lines 206 (of which only one is shown) is also provided and each of these may be selectively connected to a ground line 208 by a switched connection 210. As shown, with a positive supply voltage on line 202, column lines 204 comprise anode connections 158 and row lines 206 comprise cathode connections 154, although the connections would be reversed if the power supply line 202 was negative with respect to ground line 208.

As illustrated pixel 212 of the display has power applied to it and is therefore illuminated. To create an image connection 210 for a row is maintained as each of the column lines is activated in turn until the complete row has been addressed, and then the next row is selected and the process repeated. Alternatively a row may be selected and all the columns written in parallel, that is a row selected and a current driven into each of the column lines simultaneously, to simultaneously illuminate each pixel in a row at its desired brightness. Although the latter arrangement requires more column drive circuitry it is preferred because it allows a more rapid refresh of each pixel. In a further alternative arrangement each pixel in a column may be addressed in turn before the next column is addressed, although this is generally not preferred because of the effect, inter alia, of column capacitance as discussed below. It will be appreciated that in the arrangement of FIG. 2*a* the functions of the column driver circuitry and row driver circuitry may be exchanged.

It is usual to provide a current-controlled rather than a voltage-controlled drive to an OLED because the brightness of an OLED is determined by the current flowing through it, thus determining the number of photons it outputs. In a voltage-controlled configuration the brightness can vary across the area of a display and with time, temperature, and age, making it difficult to predict how bright a pixel will appear when driven by a given voltage. In a color display the accuracy of color representations may also be affected.

FIGS. 2*b* to 2*d* illustrate, respectively the current drive 220 applied to a pixel, the voltage 222 across the pixel and the light output 224 from the pixel over time 226 as the pixel is addressed. The row containing the pixel is addressed and at the time indicated by dashed line 228 the current is driven onto the column line for the pixel. The column line (and pixel) has an associated capacitance and thus the voltage gradually rises to a maximum 230. The pixel does not begin to emit light until a point 232 is reached where the voltage across the pixel is greater than the OLED diode voltage drop. Similarly when the drive current is turned off at time 234 the voltage and light output gradually decay as the column capacitance discharges. Where the pixels in a row are all written simultaneously, that is where the columns are driven in parallel, the time interval between times 228 and 234 corresponds to a line scan period.

FIG. 3 shows a schematic diagram 300 of a generic driver circuit for a passive matrix OLED display. The OLED display is indicated by dashed line 302 and comprises a plurality n of row lines 304 each with a corresponding row electrode contact 308 and a plurality n of column lines 308 with a corresponding plurality of column electrode contacts 310. An OLED is connected between each pair of row and column lines with, in the illustrated arrangement, its anode connected to the column line. A y-driver 314 drives the column lines 308 with a constant current and an x-driver 316 drives the row lines 304, selectively connecting the row lines to ground. The y-driver 314 and x-driver 316 are typically both under the control of a processor 318. A power supply 320 provides power to the circuitry and, in particular, to y-driver 314.

FIG. 4 shows schematically the main features of a current driver 402 for one column line of a passive matrix OLED display, such as the display 302 of FIG. 3. Typically a plurality of such current drivers are provided in a column driver integrated circuit, such as y-driver 314 of FIG. 3, for driving a plurality of passive matrix display column electrodes.

The current driver 402 of FIG. 4 outlines the main features of this circuit and comprises a current driver block 406 incorporating a bipolar transistor 416 which has an emitter terminal substantially directly connected to a power supply line 404 at supply voltage Vs. (This does not necessarily require that the emitter terminal should be connected to a power supply line or terminal for the driver by the most direct route but rather that there should preferably be no intervening components, apart from the intrinsic resistance of tracks or connections within the driver circuitry between the emitter and a power supply rail). A column drive output 408 provides a current drive to OLED 412, which also has a ground connection 414, normally via a row driver MOS switch (not shown in FIG. 4). A current control input 410 is provided to current driver block 406 and, for the purpose of illustration, this is shown connected to the base of transistor 416 although in practice a current mirror arrangement is preferred. The signal on current control line 410 may comprise either a voltage or a current signal. Where the current driver block 406 provides a variable controllable current source each current driver block may be interfaced with and controlled by an analog output from a digital to analog converter. Such a controllable current source can provide a variable brightness or grayscale display. Other methods of varying pixel brightness include varying pixel on time using Pulse Width Modulation (PWM). In a PWM scheme a pixel is either fully on or completely off but the apparent brightness of a pixel varies because of time integration within the observer's eye.

GENERAL DESCRIPTION

The inventors of the present invention have realized that digital driving methods require a continuing charge and discharge of the rows and columns of the display because in such a driving method a pixel is either fully on or fully off. Such a continuous fully on and off cycle can reduce the lifetime of an OLED display. There is a particular need for techniques which can increase the lifetime of the display which are applicable to passive matrix displays since these are very much cheaper to fabricate than active matrix displays. Reducing the drive level (and hence brightness) of an OLED can significantly enhance the lifetime of the device—for example halving the drive/brightness of the OLED can increase its lifetime by approximately a factor of four. In WO 2006 035246, WO 2006 035247 and WO 2006 035248, the contents of which are herein incorporated by reference, the applicant has in applications recognized that one solution lies in multi-line addressing techniques employed to reduce peak display drive levels, in particular in passive matrix OLED displays, and hence increase display lifetime. Broadly speaking, these methods comprise driving a plurality of column electrodes of the OLED display with a first set of column drive signals at the same time as driving two or more row electrodes of the display with a first set of row drive signals; then the column electrodes are driven with a second set of column drive signals at the same time as the two or more row electrodes are driven with a second set of row drive signals. Preferably the row and column drive signals comprise current drive signals from a substantially constant current generator such as a current source or current sink. Preferably such a current generator is controllable or programmable, for example, using a digital to analog converter.

The effect of driving a column at the same time as two or more rows is to divide the column drive between two or more rows in a proportion determined by the row drive signals—in other words for a current drive the current in a column is divided between the two or more rows in proportions determined by the relative values or proportions of the row drive signals. Broadly speaking this allows the luminescence profile of a row or line of pixels to be built up over multiple line scan period, thus effectively reducing the peak brightness of an OLED pixel thus increasing the lifetime of pixels of the display. With a current drive a desired luminescence of a pixel is obtained by means of a substantially linear sum of successive drive signals to the pixel.

A further approach particularly directed to overcome the need for continuous charging and discharging of the pixel is to replace the digital drivers with analog drivers. However, analog drivers capable of adjusting to the dynamic range of current required are expensive and difficult to realize in practice.

Accordingly, there is a need to provide improved drive schemes capable of increasing the lifetime of a display which provide a combination of the benefits of digital and analog drive.

According to a first aspect of the present invention, there is provided a method of driving an electro-optic display having a plurality of display pixels, the method comprising providing a current source; modulating the current source and generating a modulated digital signal; converting the modulated digital signal into an effective analog drive signal so that the display pixels receive an effective analog drive current, wherein the internal capacitance of the electo-optic display smooths the digitally modulated signal and generates the effective analog drive signal.

Preferably, the display is a passive matrix driven electro-optic display and the display pixels comprise organic electroluminescent material.

Preferably, the passive matrix display comprises an array of row and column electrodes and driving the row and column electrodes includes driving with first and second sets of column drive signals and first and second sets of row drive signals respectively.

Preferably, the method includes driving the column electrodes of the display with the first set of column drive signals at the same time as driving two or more row electrodes of the display with the first set of row drive signals; then driving the column electrodes with the second set of column drive signals at the same time as two or more row electrodes are driven with a second set of row drive signals.

Preferably, said first and second column drive signals and said first and second row drive signals are selected such that a desired luminescence of pixels in the display driven by the row and column electrodes is obtained by a substantially linear sum of luminances determined by the first row and column drive signals and luminances.

Preferred values of modulation frequency include modulating at a modulation frequency of above 1 MHz. Preferably, within the range of 1 Mhz to 2 Mhz.

Preferred methods of digitally modulating include pulse width modulation and delta-sigma modulation.

BRIEF DESCRIPTION OF THE DRAWINGS

These and further embodiments of the invention will now be described, by way of example only, and with reference to the accompanying figures in which:

FIGS. 2*a* and 2*d* show, respectively, a conceptual driver arrangement for a passive matrix OLED display, a graph of current drive against time for a display pixel, a graph of pixel voltage against time, and a graph of pixel light output against time;

DETAILED DESCRIPTION

Figure 1A:
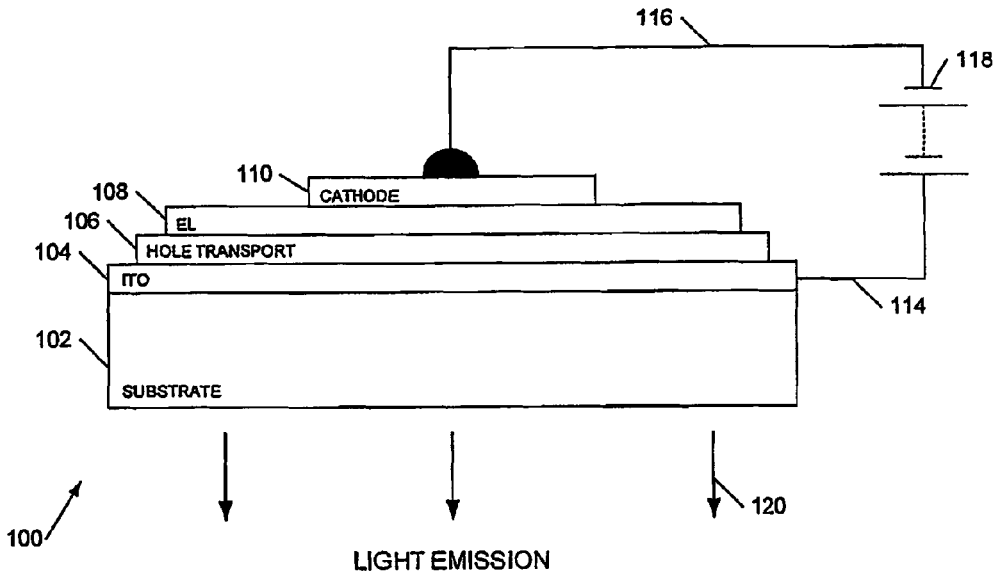
Figure 1a (PRIOR ART)
FIGS. 1*a* and 1*b* show cross sections through, respectively, an organic light emitting diode and a passive matrix OLED display.
Figure 1B:
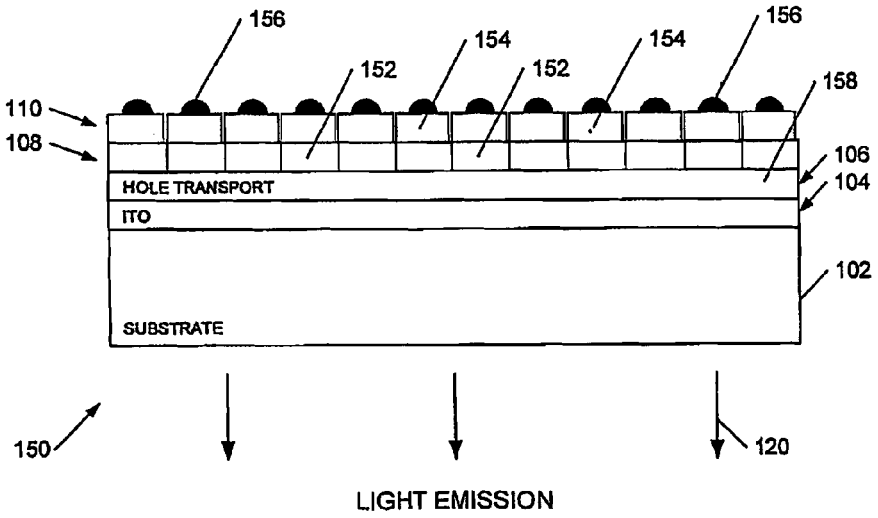
Figure 1b (PRIOR ART)
Figure 3:
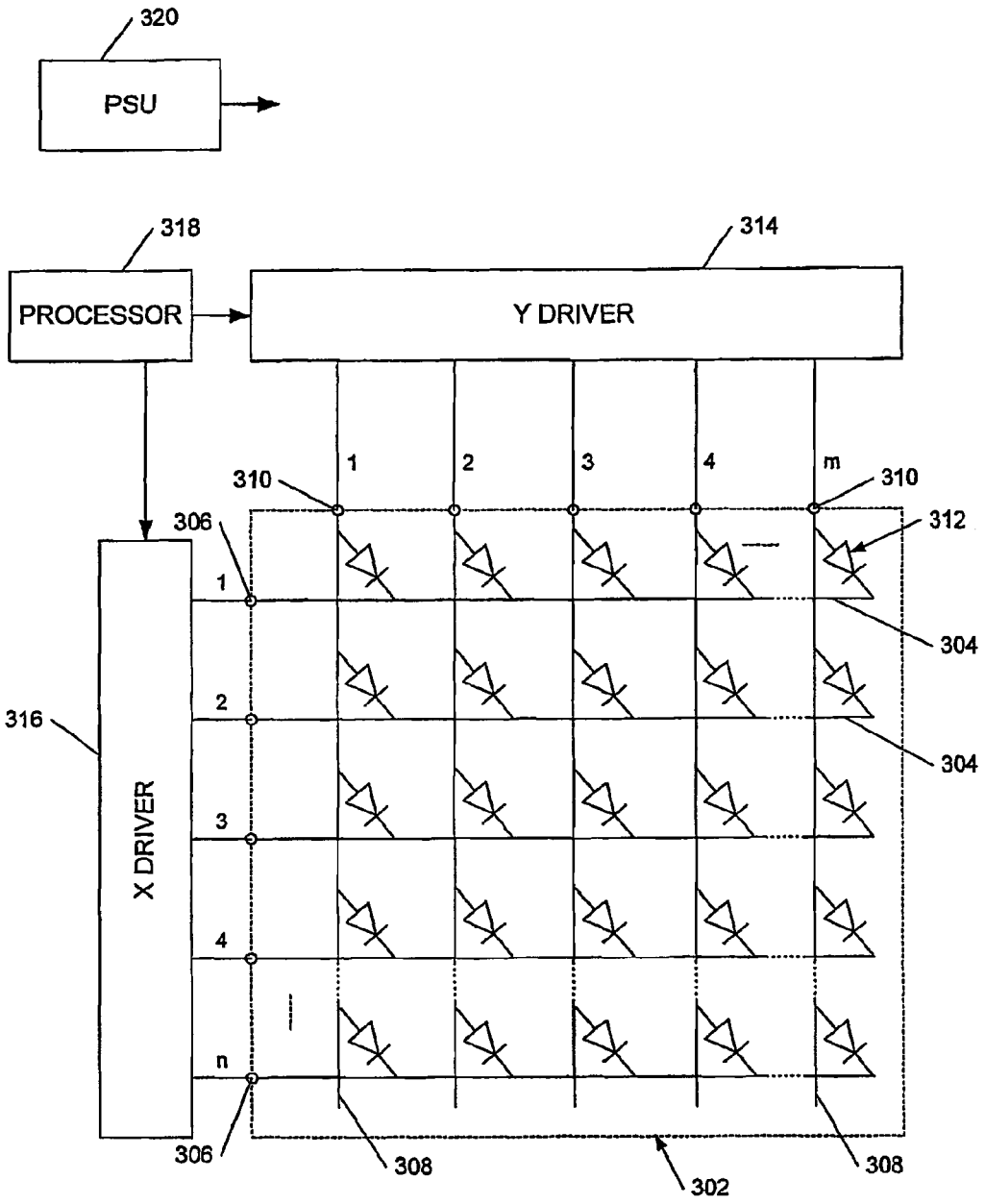
Figure 3 (PRIOR ART)
FIG. 3 shows a schematic diagram of a generic driver circuit for a passive matrix OLED display according to the prior art.
Figure 4:
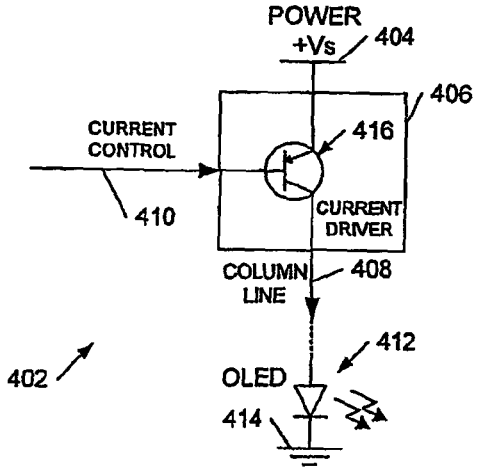
FIG. 4 shows a current driver for a column of a passive matrix OLED display.
Figure 5:
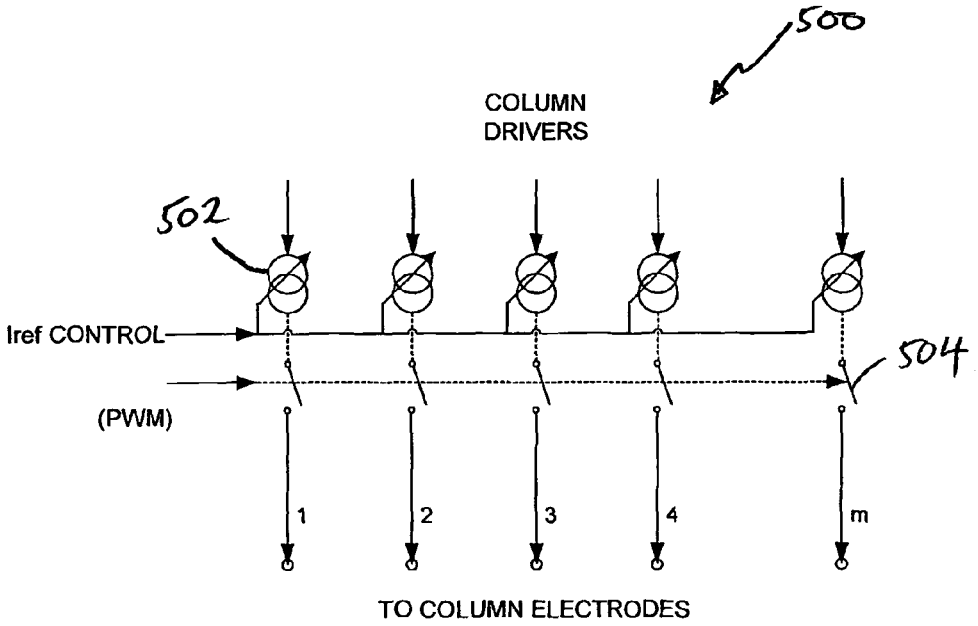
FIG. 5 shows a column driver according to an embodiment of the present invention.

Referring to FIG. 5, column drivers 500 according to an embodiment of the present invention comprise a set of adjustable substantially constant current sources 502 which are grouped together. In general terms, a number of switches 504 are provided to dither the current and provide a fast switching modulation to modify the output of one or a series of the current sources 502.

The fast switching modulation is performed at a frequency greater than the RC time constant of the display device. More particularly, the frequency of the digital modulation is greater than the cutoff frequency of the display so that the capacitance of the display smooths the signal so that the pixels "see" an effective analog drive signal and not a constant charge and discharge digital drive. The modulation frequency is greater than 0.5MHz although specific embodiments benefit from a higher frequency of greater than 1 Mhz, 1.5MHz or 2MHz.

As drawn in FIG. 5 each current source 502 is provided with a variable reference current Iref for setting the current into each of the column electrodes. The reference current Iref is digitally modulated by techniques known in the art. Such techniques include pulse modulation methods such as pulse width modulation and sigma delta modulation. For multi-line addressing methods the reference current can be digitally modulated by a different value for each column derived from a row of a factor matrix as described in WO 2006/035247.

Figure 6:
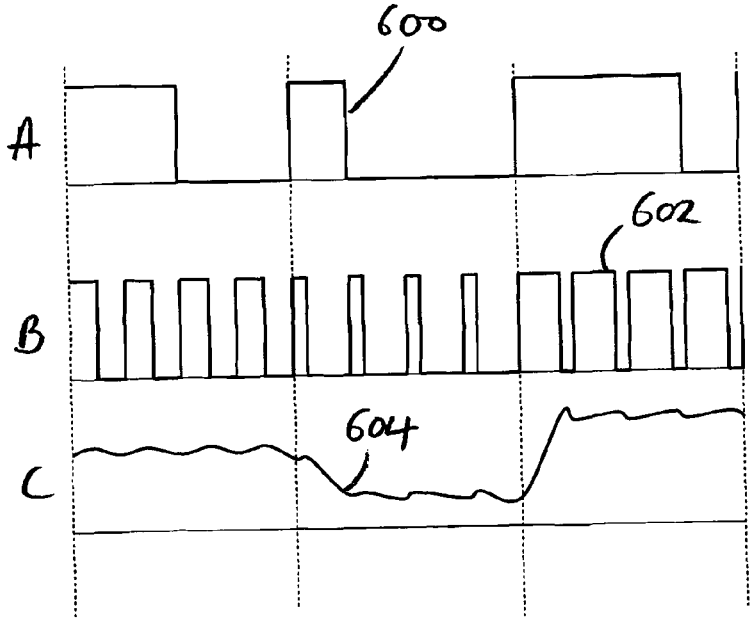
FIG. 6 shows a graph of current against time for three drive schemes applied to a display according to an embodiment of the invention.

As best seen in FIG. 6, a graph of modulated current against time shows in graph A, a standard prior art pulse width modulated signal 600 having a frequency of around 100Hz. Each rise and fall represents a charge and discharge of an electroluminescent pixel of the display. Referring to graph B a high speed pulse width modulated signal 602 is provided at a frequency of over 1 MHz. Graph C represents the effective analog drive signal 604 used to drive the electroluminescent pixels of the display following smoothing of the high speed modulated signal B by the display.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of driving an electro-optic display having a plurality of display pixels, the method comprising providing a current source; digitally modulating the current source at a modulation frequency and generating a modulated digital signal; and converting the modulated digital signal into an effective analog drive signal so that the display pixels receive an effective analoq drive current, wherein the internal capacitance of each display pixel of the electro-optic display gives rise to an RC time constant of each display pixel such that the modulation frequency is above the cutoff frequency determined by the RC time constant for each display pixel, and wherein the internal capacitance smooths the digitally modulated signal and generates the effective analoq drive signal, wherein the digitally modulating is at a modulation frequency within the range of 1 MHz to 2 MHz.

2. A method as claimed in claim 1, wherein the display is a passive matrix driven electro-optic display.

3. A method as claimed in claim 2, wherein the display pixels comprise organic electroluminescent material.

4. A method as claimed in claim 2, wherein the passive matrix display comprises an array of row and column electrodes and driving the row and column electrodes includes driving with first and second sets of column drive signals and first and second sets of row drive signals respectively.

5. A method as claimed in claim 4, including driving the column electrodes of the display with the first set of column drive signals at the same time as driving two or more row electrodes of the display with the first set of row drive signals; then driving the column electrodes with the second set of column drive signals at the same time as two or more row electrodes are driven with a second set of row drive signals.

6. A method as claimed in claim 4, wherein said first and second column drive signals and said first and second row drive signals are selected such that a desired luminescence of pixels in the display driven by the row and column electrodes is obtained by a substantially linear sum of luminances determined by the first row and column drive signals and luminances.

7. A method as claimed in claim 1, wherein the digitally modulating comprises pulse width modulation.

8. A method as claimed in claim 1, wherein the digitally modulating comprises delta-sigma modulation.

* * * * *